US011191332B2

(12) United States Patent
Zemiro

(10) Patent No.: US 11,191,332 B2
(45) Date of Patent: Dec. 7, 2021

(54) FOLDING PIECE OF LUGGAGE

(71) Applicant: Patrick Zemiro, Paris (FR)

(72) Inventor: Patrick Zemiro, Paris (FR)

( * ) Notice: Subject to any disclaimer, the term of this patent is extended or adjusted under 35 U.S.C. 154(b) by 356 days.

(21) Appl. No.: 16/477,057

(22) PCT Filed: Jan. 12, 2018

(86) PCT No.: PCT/FR2018/050081
§ 371 (c)(1),
(2) Date: Jul. 10, 2019

(87) PCT Pub. No.: WO2018/130794
PCT Pub. Date: Jul. 19, 2018

(65) Prior Publication Data

US 2019/0328094 A1 Oct. 31, 2019

(30) Foreign Application Priority Data

Jan. 16, 2017 (FR) ..... 1750314

(51) Int. Cl.
*A45C 7/00* (2006.01)
*A45C 13/26* (2006.01)
(Continued)

(52) U.S. Cl.
CPC ..... *A45C 7/0036* (2013.01); *A45C 7/0063* (2013.01); *A45C 13/26* (2013.01);
(Continued)

(58) Field of Classification Search
CPC ..... A45C 7/0036; A45C 7/0063; A45C 12/26; A45C 5/14; A45C 13/005; A45C 2005/032
See application file for complete search history.

(56) References Cited

U.S. PATENT DOCUMENTS 844,955 A * 2/1907 Morgan ..... B65D 21/086 220/8
2,710,084 A 6/1955 Braverman
(Continued)

FOREIGN PATENT DOCUMENTS

GB 520283 A 4/1940
GB 727879 A 4/1955
(Continued)

OTHER PUBLICATIONS

International Search Report for corresponding PCT application No. PCT/FR2018/050081, dated Apr. 12, 2018.

*Primary Examiner* — Tri M Mai
(74) *Attorney, Agent, or Firm* — Notaro, Michalos & Zaccaria P.C.

(57) ABSTRACT

Folding piece of luggage includes parallel first and second rigid panels; third and fourth rigid panels each mounted on and articulated to one of the first and second panels between a deployed position and a retracted position in which the third or fourth panel extends parallel to first and second panels; third and fourth panels defining with the first and second panels a rigid frame when third and fourth panels are in their deployed position; fifth and sixth panels each connects the first and second panels and define with the other panels an internal storage space of parallelepipedal shape; fifth and sixth panels being deformable in a direction x perpendicular to the first and second panels between an unfolded position and a folded position so that, when third and fourth panels are in their retracted position, first and second panels are able to move relative to one another.

11 Claims, 5 Drawing Sheets

(51) Int. Cl.
*A45C 5/14* (2006.01)
*A45C 13/00* (2006.01)
*A45C 5/03* (2006.01)

(52) U.S. Cl.
CPC ..... *A45C 5/14* (2013.01); *A45C 13/005* (2013.01); *A45C 2005/032* (2013.01)

(56) References Cited

U.S. PATENT DOCUMENTS

| | | | | |
|---|---|---|---|---|
| 2,718,943 | A * | 9/1955 | Braverman | A45C 7/0036 190/107 |
| 5,086,888 | A | 2/1992 | Chu | |
| 6,267,393 | B1 * | 7/2001 | Mengrone | A45C 5/14 280/30 |
| 7,500,547 | B2 * | 3/2009 | Bettua | A45C 5/14 190/103 |
| 10,327,523 | B2 * | 6/2019 | Liang | A45C 13/30 |
| 10,485,311 | B2 * | 11/2019 | Armani | A45C 5/146 |
| 2005/0157960 | A1 | 7/2005 | Godshaw et al. | |
| 2009/0057307 | A1 | 3/2009 | Jung et al. | |
| 2019/0166991 | A1 * | 6/2019 | Sawachi | A45C 7/0027 |
| 2021/0085046 | A1 * | 3/2021 | Atlas | A45C 3/06 |

FOREIGN PATENT DOCUMENTS

| | | | |
|---|---|---|---|
| GB | 1500083 | A | 2/1978 |
| WO | 2014127497 | A1 | 8/2014 |

* cited by examiner

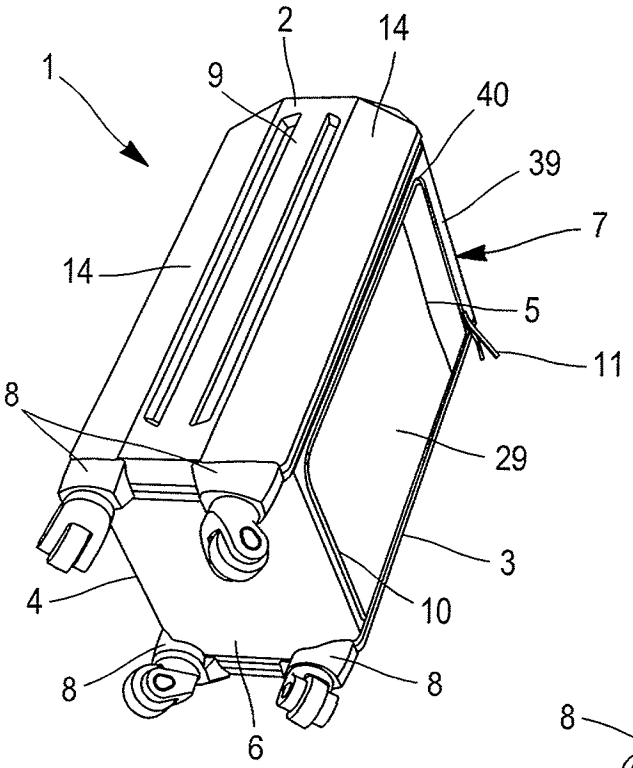
FIG. 1
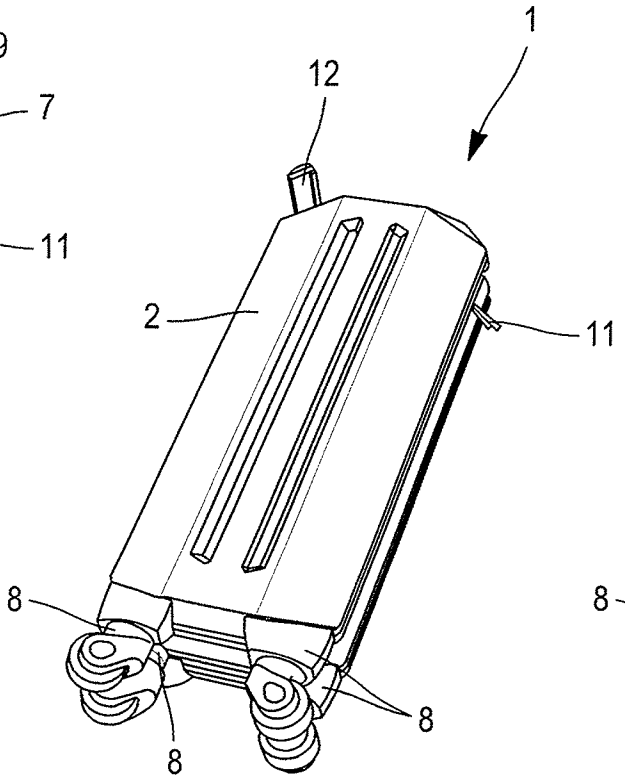
FIG. 2
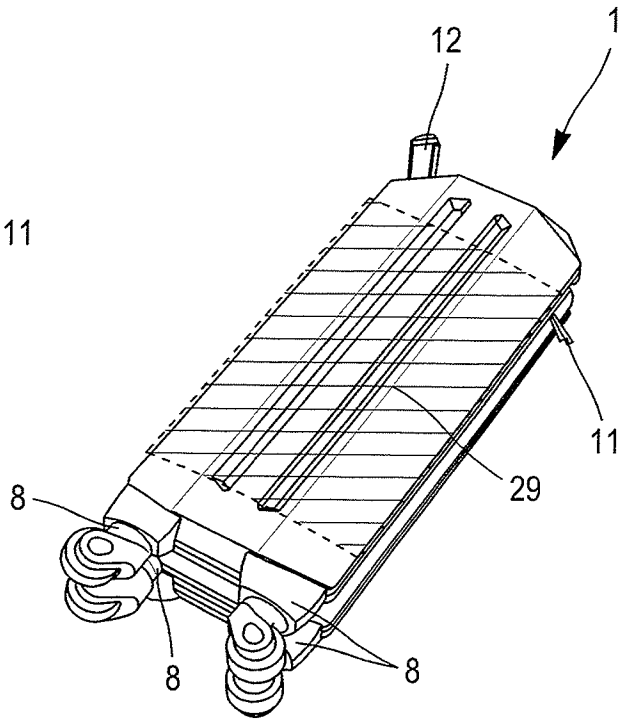
FIG. 7
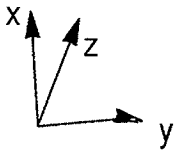

FOLDING PIECE OF LUGGAGE

TECHNICAL FIELD

The invention relates to the field of luggage and more particularly to a folding piece of luggage.

TECHNOLOGICAL BACKGROUND

Luggage aims to enable the transportation of diverse and varied objects. Thus suitcases for example enable transportation of clothes or other objects that may be of use when traveling.

It is advantageous to maximize the volume of objects that can be transported by a single piece of luggage. When not being used, luggage must be stored in order to be used for future journeys. Also, luggage is unnecessarily bulky when empty.

It is consequently advantageous to reduce the overall size of luggage when empty. To this end, flexible luggage is known that enables very significant reduction of the overall size when empty. However, and on the other hand, they are generally vulnerable to deterioration and do not protect their contents well against impact or theft.

SUMMARY

The basic idea of the invention is to propose a piece of luggage that is, on the one hand, of relatively small overall size when not being used and, on the other hand, sufficiently rigid when it is being used to protect its contents effectively.

To this end, the invention provides a folding piece of luggage including:

parallel first and a second rigid panels;

third and fourth rigid panels, each of which is mounted on and articulated to one of the first and second panels between a deployed position in which said third or fourth panel extends between said first and second panels, perpendicularly to said first and second panels, and a retracted position in which said third or fourth panel extends parallel to said first and second panels; the third and fourth panels defining with the first and second panels a rigid frame when the third and fourth panels are in their deployed position;

fifth and sixth panels each of which connects the first and second panels and that define with the first, second, third and fourth panels, when said third and fourth panels are in their deployed position, an internal storage space of parallelepipedal shape; the fifth and sixth panels being deformable in a direction x perpendicular to said first and second panels between an unfolded position and a folded position so that, when the third and fourth panels are in their retracted position, the first and second panels are able to move relative to one another in the direction x between an apart position of use in which the fifth and sixth panels are in their unfolded position and a together storage position in which the fifth and sixth panels are in their folded position.

Thanks to an arrangement of the above kind, the first, second, third and fourth panels form a rigid frame conferring on the piece of luggage in its unfolded configuration of use a stiffness enabling it to protect its contents effectively. Moreover, the overall size of the piece of luggage is very small when the first and second panels are in their together storage position.

According to other advantageous embodiments, a folding piece of luggage of this kind may have one or more of the following features.

According to one embodiment, the fifth panel is made from a flexible material and includes:

a frame defining an opening enabling access to the internal storage space;

a mobile flap that is secured to the frame and that is able to close the opening of the frame in a closed position; and a first fixing device configured to hold the mobile flap fixed to the frame in its closed position.

According to one embodiment, the fifth panel is made of fabric.

According to one embodiment, the mobile flap is adapted to be positioned in a clamping position in which said mobile flap is wrapped around the first and second panels when said first and second panels are in their together position so as to retain them in said together position, the folding piece of luggage including a second fixing device configured to hold the mobile flap in its clamping position. This provides a simple way to lock the folding piece of luggage in its folded storage configuration.

According to one embodiment, the mobile flap has a rectangular shape and has an edge that is secured to the frame and three other edges that are adapted to be fixed to the frame in the closed position of the mobile flap by the first fixing device.

According to one embodiment, the edge of the mobile flap that is secured to the frame is parallel to one of the first and second panels.

According to one embodiment, the first fixing device includes a zip fastener adapted to secure the mobile flap to the frame. According to another embodiment, the first fixing device includes one or more self-gripping surfaces that are fixed to the frame and each of which is adapted to cooperate with a complementary self-gripping surface fixed to the mobile flap.

According to one embodiment, the third and fourth panels are respectively mounted on and articulated to the first and second panels. The dimensional constraints are therefore reduced.

According to one embodiment, the folding piece of luggage includes a set of fabric elements that are fixed between the first and second panels and cover the sixth panel as well as the third and fourth panels when they are in their deployed position, the set of fabric elements being moreover fixed to the fifth panel and with said fifth panel defining a flexible envelope for keeping the internal storage space closed when said third and fourth panels are in their retracted position.

According to one embodiment, the sixth panel is made from a rigid material and includes a central portion and two side portions that are disposed on respective opposite sides of the central portion in the direction x, each of said side portions being, on the one hand, mounted on and articulated to one of the first and second panels about a geometrical axis perpendicular to the direction x and, on the other hand, mobile in rotation relative to the central portion about a geometrical axis perpendicular to the direction x.

According to one embodiment, the folding piece of luggage further includes a holding device that is fixed to the central portion of the sixth panel.

According to one embodiment, the holding device includes a sheath that is fixed to the central portion of the sixth panel, a telescopic handle that is housed in said sheath and a handgrip that is fixed to one end of said telescopic handle.

According to one embodiment, each of said side portions is mounted on and articulated to one of the first and second panels by means of one or more hinges.

According to one embodiment, each of the side portions is connected to the central portion by a fold line providing a degree of freedom in rotation of said side portions relative to the central portion.

According to one embodiment, the folding piece of luggage includes, for each of the third and fourth panels, a locking device adapted when in an active state to retain said third or fourth panel in its deployed position.

According to one embodiment, each locking device includes a clip that is mounted on and pivoted on one of the first and second panels between an active position in which said clip presses a distal end of one of the third and fourth panels against a rim of one of the first and second panels so as to prevent movement of said third or fourth panel from its deployed direction to its retracted position and an inactive position in which said clip allows movement of said third or fourth panel between its retracted position and its deployed position.

According to another embodiment, each clip is, in its active position, in contact against a tab arranged at the distal end of said third or fourth panel, said clip and said tab being adapted to exert a resistive friction torque opposing the movement of the clip from its active position to its inactive position.

According to one embodiment, a foam element is disposed between each of the third and fourth panels and the respective rim when said third and fourth panels are in their deployed position.

According to one embodiment, the folding piece of luggage includes at least two castor mechanisms that are respectively fixed to the first and second panels, on respective opposite sides of the third panel.

BRIEF DESCRIPTION OF THE FIGURES

The invention will be better understood and other objects, details, features and advantages thereof will become more clearly apparent in the course of the following description of particular embodiments of the invention given by way of nonlimiting illustration only and with reference to the appended drawings.

FIG. 1 represents a perspective view of a folding piece of luggage in accordance with the invention in an unfolded configuration of use.

FIG. 2 represents a perspective view of the folding piece of luggage from FIG. 1 in a folded storage configuration.

FIG. 7 represents a perspective view of a folding piece of luggage in which the folding piece of luggage is locked in its folded storage configuration by a mobile flap.

DETAILED DESCRIPTION OF EMBODIMENTS

Figure 3:
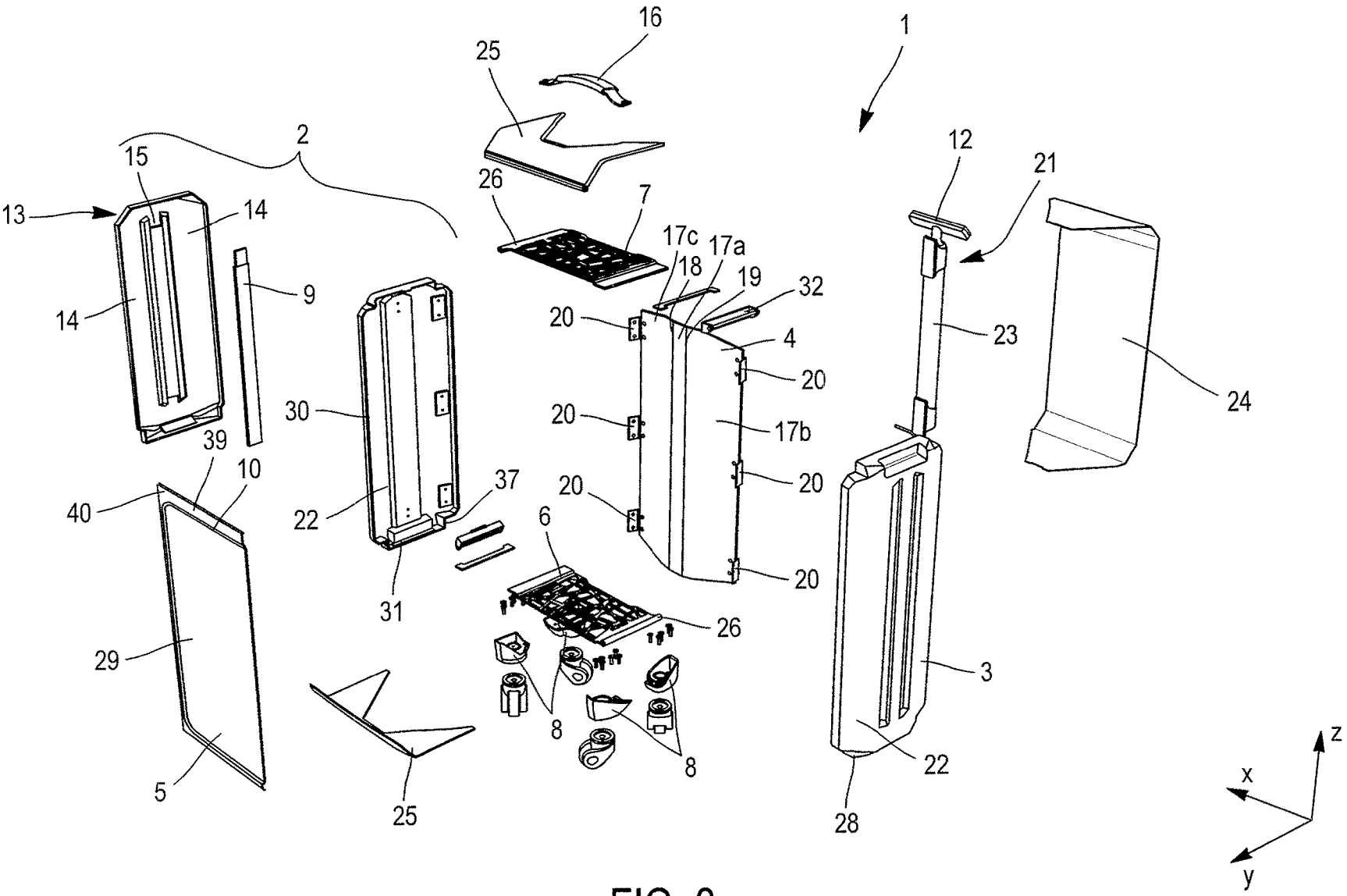
FIG. 3 represents an exploded perspective view of the folding piece of luggage from FIG. 1.

In the description, a three-dimensional orthonormal system of axes defined by three axes x, y, z and represented in FIGS. 1 and 3 is used to describe the elements of the folding piece of luggage.

There is described hereinafter with reference to the appended figures a folding piece of luggage according to one embodiment. In that embodiment the folding piece of luggage is a suitcase.

The suitcase 1 is represented in an unfolded configuration of use in FIG. 1 and in a folded storage configuration in FIG. 2. The suitcase 1 includes six panels 2, 3, 4, 5, 6, 7 each of which has a rectangular general shape and that are disposed perpendicularly to one another so as to define a rectangular parallelepiped. When the suitcase 1 is in its unfolded configuration of use, the six panels 2, 3, 4, 5, 6, 7 therefore together define an internal storage space that has a rectangular parallelepipedal shape and that is adapted to receive objects.

The suitcase 1 more particularly includes:

two parallel rigid side panels 2, 3;

a front panel 5 and a back panel 4 that are parallel to one another, connect the two side panels 2, 3 and form the largest two faces of the rectangular parallelepiped when the suitcase 1 is in its unfolded configuration of use; and a rigid bottom panel 6 and a rigid top panel 7 that are parallel to one another and form the smallest two faces of the rectangular parallelepiped when the suitcase 1 is in its unfolded configuration of use.

When the suitcase 1 is in its unfolded position of use represented in FIG. 1 each of the side panels 2, 3 lies in a plane parallel to the axes z and y, the front back panels 5, 4 each lie in a plane parallel to the axes x and z and the bottom panel 6 and the top panel 7 each lie in a plane parallel to the axes x and y.

The bottom panel 6 and the top panel 7 are respectively mounted on and articulated to the two side panels 2, 3. As shown in FIG. 3, the bottom panel 6 is more particularly mounted on the side panel 3 to pivot about a shaft 26 at the bottom end of the internal surface of said side panel 3. Similarly, the top panel 7 is mounted on the side panel 2 to pivot about a shaft 26 at the top end of the internal surface of said side panel 2. The shafts 26 on which the bottom panel 6 and the top panel 7 pivot are parallel to one another and oriented parallel to the axis y. Each of the bottom panel 6 and the top panel 7 is mounted on one of the side panels 2, 3 to be mobile between a deployed position in which said bottom panel 6 or said top panel 7 extends between the two side panels 2, 3, perpendicularly thereto, i.e. in a plane parallel to the axes x and y, and a retracted position in which said bottom panel 6 or said top panel 7 is folded against the side panel 2, 3 to which it is articulated and therefore lies substantially parallel to the side panels 2, 3, i.e. in a plane parallel to the axes y and z.

When they are in their deployed position the bottom panel 6 and the top panel 7 define with the side panels 2, 3 a rigid frame adapted to stiffen the suitcase 1. When they are in their retracted position the bottom panel 6 and the top panel 7 allow relative movement of the side panels 2, 3 with respect to one another in the direction x between an apart position of use represented in FIG. 1 and a together storage position illustrated in FIG. 2.

Moreover, the front panel 5 and the back panel 4 are deformable in the direction x between an unfolded position illustrated in FIG. 1 and a folded position illustrated in FIG. 2.

To go from the unfolded configuration of use illustrated in FIG. 1 to the folded storage configuration illustrated in FIG. 2 the user therefore first moves the bottom panel 6 and the top panel 7 from their deployed position to their retracted position, in which they are folded against the side panels 2, 3. The side panels 2, 3 are then moved toward one another in the direction x from their apart position to their together position. The front panel 5 and the back panel 4 are simultaneously deformed to their folded position as the side panels 2, 3 move closer.

Conversely, to go from the folded storage configuration to the unfolded configuration of use, the user moves the side panels 2, 3 away from one another to their apart position. The front panel 5 and the back panel 4 are simultaneously deformed to their unfolded position as the side panels 2, 3 move apart. Then, when the side panels 2, 3 are in their apart position, the bottom panel 6 and the top panel 7 are moved from their retracted position to their deployed position in which they form with the side panels 2, 3 a rigid frame.

The particular structure of the various components of the suitcase 1 is described below with reference to FIG. 3.

The side edges of the front panel 5 are fixed to the two side panels 2, 3. The front panel 5 is made of fabric for example. It is therefore able to deform to allow the movement of the side panels 2, 3 between their apart position and their together position. The front panel 5 includes a U-shaped slot 39 to form a frame 40 defining a rectangular opening allowing access to the internal storage space and a mobile flap 29 of rectangular shape that is able to close the opening in a closed position or to leave said opening accessible in an open position. The front panel 5 also includes a fixing device that is configured to retain the mobile flap 29 in its closed position. In the embodiment represented, the fixing device includes a zip fastener 10 extending along the U-shaped slot 39 and enabling connection of the three free edges of the mobile flap 29 to the facing three edges of the frame 40. The zip fastener 10 is equipped with one or more tabs 11 enabling the user to open the mobile flap 29 in order to access the internal storage space or to close the mobile flap 29. In another embodiment that is not represented, the fixing device includes self-gripping surfaces of the velvet and hook type. Thus the frame 40 is equipped with one or more self-gripping surfaces each of which is adapted to cooperate with a complementary self-gripping surface carried by the mobile flap 29.

The mobile flap 29 is advantageously adapted to be positioned in a clamping position in which it is wrapped around the side panels 2, 3 in such a manner as to hold them in their together position, as represented in FIG. 7. In FIG. 7 the mobile flap 29 is represented diagrammatically by means of dashed lines and cross-hatching. As represented in FIG. 1 for example, the U-shape slot 39 producing the mobile flap 29 is oriented so that the edge of the mobile flap 29 that connects the mobile flap 29 to the frame 40 extends along one of the side panels 2, 3; this facilitates wrapping said mobile flap 29 around the side panels 2, 3. Also, the suitcase 1 is equipped with a second device, not represented, enabling retention of the mobile flap 29 in its clamping position. According to one embodiment, the second fixing device includes self-gripping surfaces of the velvet and hook type. For example, the second fixing device includes a first self-gripping surface that is arranged on the external surface of the mobile flap 29 and adapted to cooperate with a complementary second self-gripping surface that is fixed to the side panel 2 or to the front panel 5. Alternatively, depending on the dimensions of the suitcase 1, the second self-gripping surface may also be fixed to the mobile flap 29 itself so that the mobile flap 29 is fixed to itself after it has been wrapped completely around the suitcase 1 in its folded storage configuration. According to another embodiment, the second fixing device may equally be produced by means of one or more poppers.

The back panel 4 is made from a rigid plastic material such as polyethylene or polyvinyl. In order to enable its deformation about the axis x when the side panels 2, 3 are moved toward one another in the direction of their together position, the back panel 4 includes a central portion 17*a* and two side portions 17*b*, 17*c* that are disposed on respective opposite sides of the central portion 17*a* in the direction x, as represented in FIG. 3. Each of the side parts 17*b*, 17*c* is, on the one hand, mobile in rotation about a geometrical axis parallel to the axis z relative to the side panel 2, 3 to which said side portions 17*b*, 17*c* is connected and, on the other hand, mobile in rotation about a geometrical axis parallel to the axis z relative to said central portion 17*a*. In FIG. 3 each of the side portions 17*b*, 17*c* is connected to one of the side panels 2, 3 by one or more hinges 20 in such a manner as to enable the rotation of said side portions 17*b*, 17*c* relative to the side panels 2, 3. Also, each of the side portions 17*b*, 17*c* is connected to the central portion 17*a* by a fold line 18, 19 providing a degree of freedom in rotation of said side portions 17*b*, 17*c* relative to the central portion 17*a*. By way of example, the fold lines 18, 19 are formed by reducing the material thickness along a line parallel to the axis z and are produced when molding the back panel 4.

In other embodiments, the articulations between the side panels 2, 3 and the side portions 17*b*, 17*c* of the back panel 4 are produced by means of fold lines. Likewise, in other embodiments, each articulation between one of the side portions 17*b*, 17*c* and the central portion 17*a* may be produced by means of one or more hinges.

The suitcase 1 further includes a holding device 21 that is fixed to the central portion 17*a* of the back panel 4. The holding device 21 includes a handgrip 12 that is fixed to the end of a telescopic handle. For its part the telescopic handle is housed in a sheath 23 that is fixed to the central portion 17*a* of the back panel 4. When the telescopic handle is in a retracted state, the handgrip 12 is slightly above the top edge of the side panels 2, 3 in such a manner that said handgrip 12 does not interfere with the side panels 2, 3 when they move in the direction of their together position.

In the embodiment represented, the top panel 7 and the bottom panel 8 are of openwork construction in such a manner as to limit the weight of the suitcase 1. In this case, said top panel 7 and said bottom panel 8 are covered with a fabric covering in such a manner as to guarantee that the internal storage space is enclosed.

The suitcase 1 further includes a fabric back element 24 that includes a rectangular portion that covers the back panel 4 and the sheath 23 of the holding device 21 and therefore enables concealment of said sheath 23. The side edges of the fabric back element 24 are fixed to the side panels 2, 3. The fabric back element 24 also includes two triangular portions that respectively cover the top panel 7 and the bottom panel 6 when the suitcase 1 is in its unfolded configuration of use. The suitcase 1 also includes top and bottom fabric elements 25 including a cut-out corresponding to the triangular portions of the fabric back element 24 and each of which is fixed, for example sewn, to the adjacent triangular portion of the fabric back element 24. The fabric top and bottom elements 25 are also fixed to the side panels 2, 3 and to the front panel 5. Consequently, the fabric back element 24 and the fabric top and bottom elements 25 form with the front panel 5 a flexible enclosure enabling the internal storage space to remain enclosed when the bottom panel 6 and the top panel 7 are in their retracted position and consequently enable concealment in particular of the bottom panel 6 and the top panel 7, their articulation and the locking devices of said bottom panel 6 and said top panel 7.

The suitcase 1 further includes a handgrip 16 that is fixed to the piece of fabric 25 covering the top panel 7.

The side panels 2, 3 are made from a rigid plastic material such as polyethylene or polyvinyl. The side panel 3 includes a rigid plastic shell 22 that is slightly convex toward the exterior of the suitcase 1. Also, the side panel 2 includes two rigid shells 13, 22, namely an external shell 13 and an internal shell 22, that are slightly convex toward the exterior and fixed to one another. The external shell 13 includes a slot 15 inside which is housed a handgrip 9 that is fixed at each of its ends to the internal shell 22. Alternatively, the other side panels 3 may also include an external rigid shell and an internal rigid shell fixed one into the other.

According to one embodiment, the connection between the side panels 2, 3 and the flexible elements such as the front panel 5, the fabric back element 24 and the fabric top and bottom elements 25 is produced by pinching the edges of said flexible elements between the external and internal shells of each of the side panels 2, 3. Alternatively, this connection may be provided by hot gluing and/or by sewing.

The suitcase 1 is also equipped with a set of four castor mechanisms 8 enabling movement of the suitcase 1. Two of the castor mechanisms 8 are fixed to the bottom end of the side panel 2 while the other two are fixed to the bottom end of the other side panel 3. Fixing the castor mechanisms 8 to the rigid side panels 2, 3 enables fixing of the castors on rigid zones in the same plane whatever the configuration of the suitcase 1. Each castor mechanism 8 includes a shaft on which its castor rotates about an axis parallel to the axis x and preferably also enables rotation of the rotation shaft of the castors about an axis parallel to the axis z.

Figure 4:
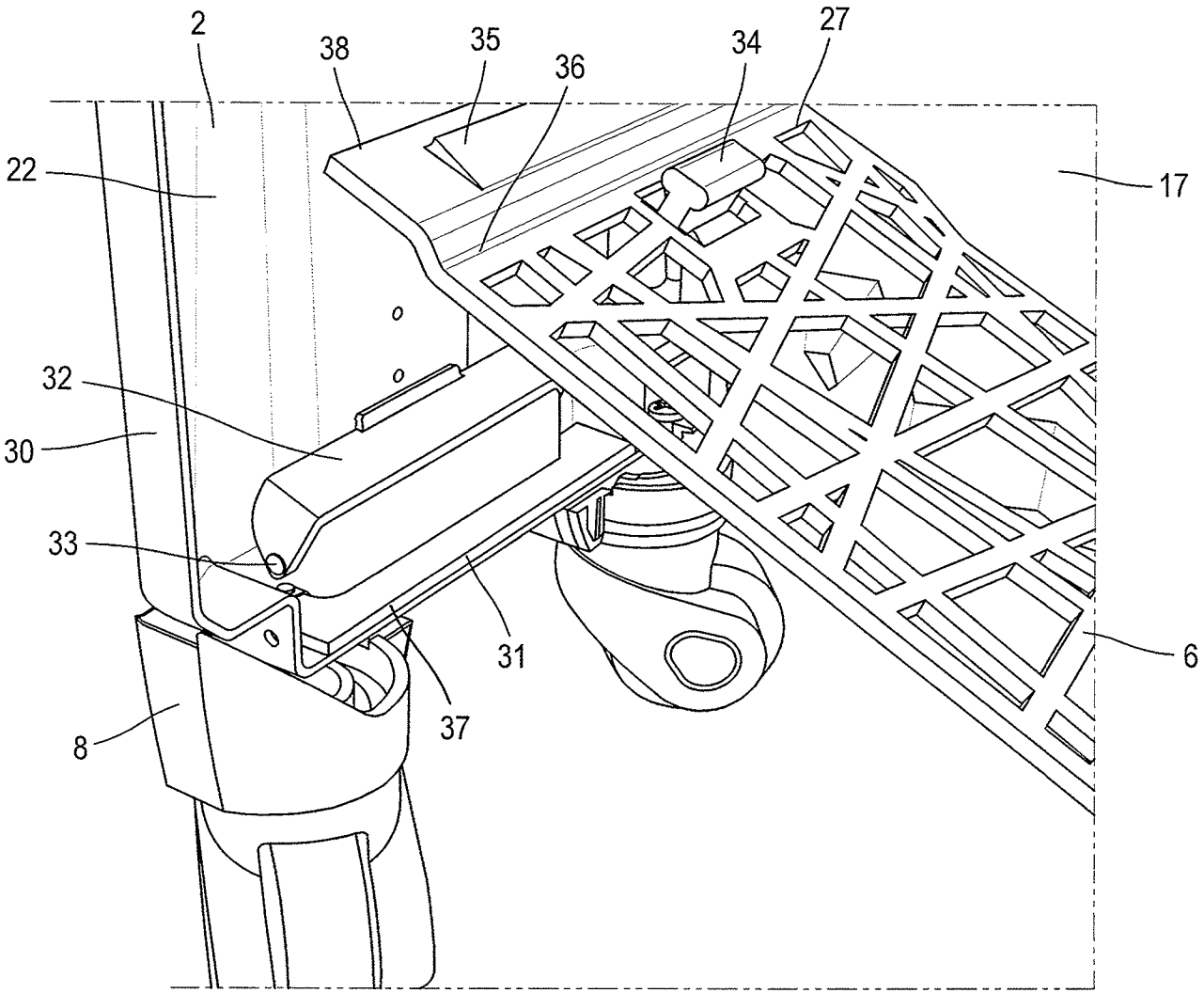
FIG. 4 represents a perspective view of a detail of a locking device adapted, in an active state, to retain the folding piece of luggage from FIG. 1 in an unfolded configuration of use.
Figure 5:
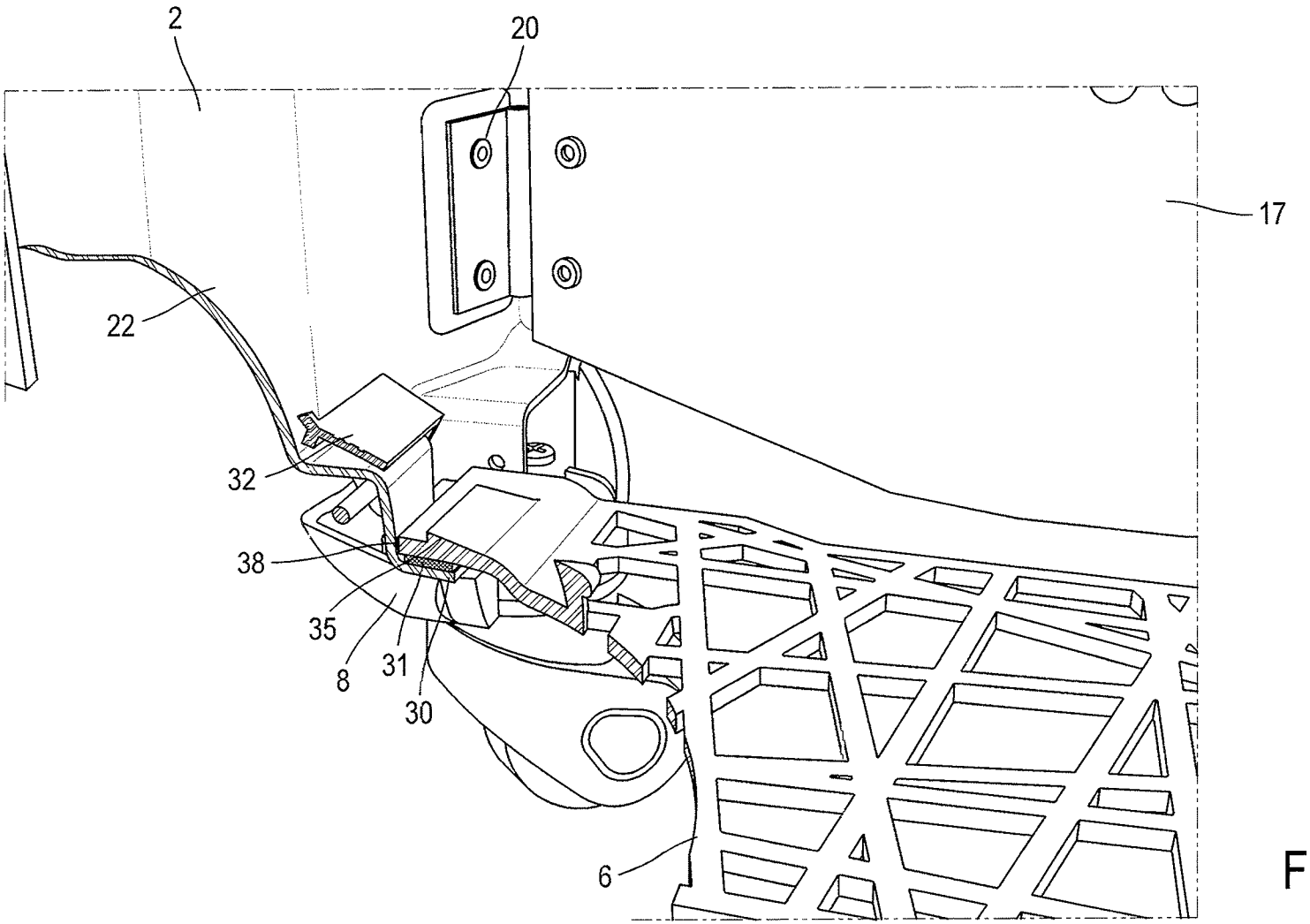
FIG. 5 represents a cut away perspective view of the detail from FIG. 4 when the folding piece of luggage is in its unfolded configuration of use.
Figure 6:
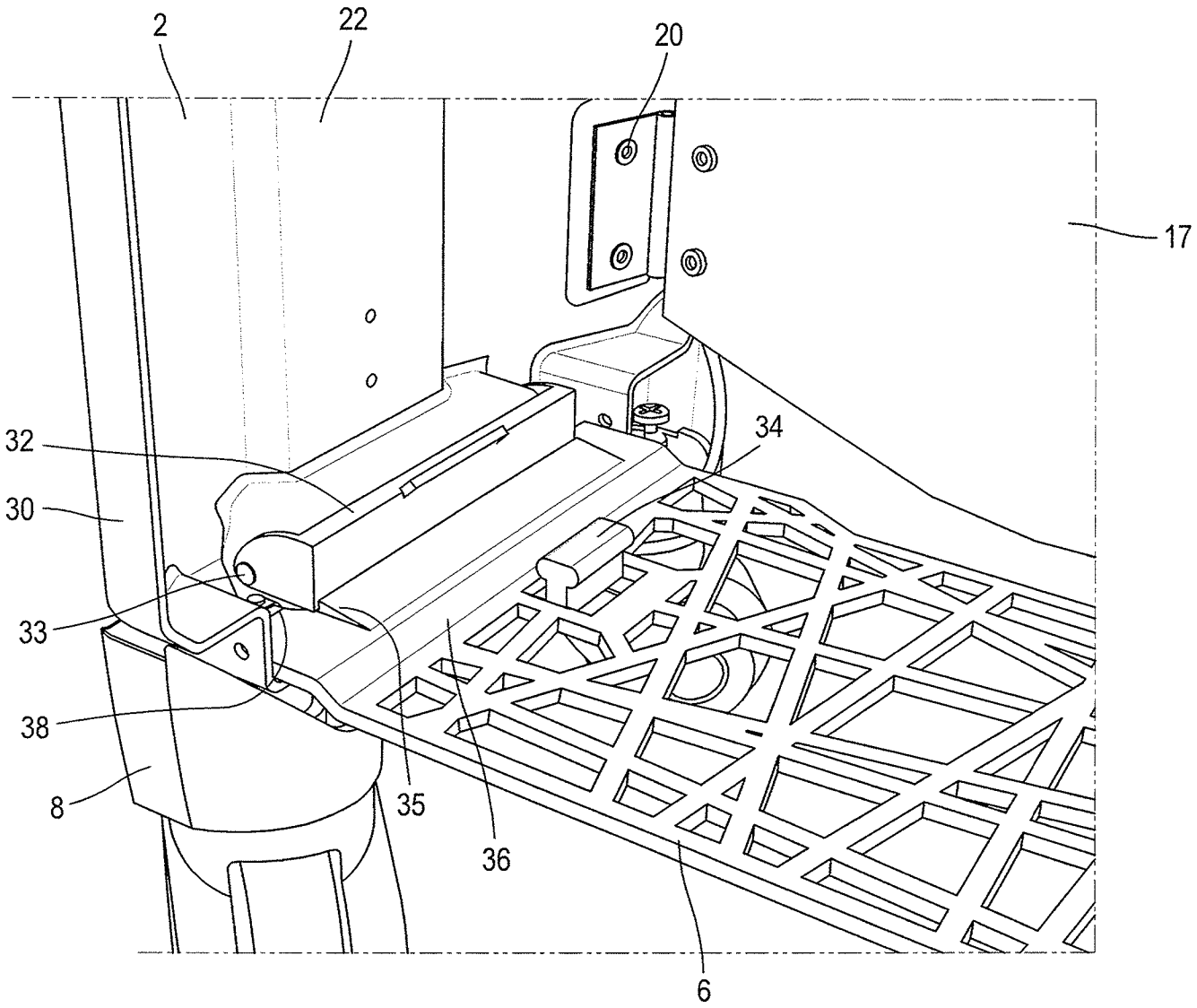
FIG. 6 represents a perspective view of the detail from FIG. 4 when the folding piece of luggage is in its unfolded configuration of use.

The suitcase 1 advantageously further includes a locking device, illustrated in FIGS. 4 to 6, adapted, in an active state, to retain the top panel 7 and the bottom panel 6 in their deployed position. The following description is given in relation to the locking device of the bottom panel 6. However, the locking device of the top panel 7 has an identical structure.

Each of the side panels 2 and 3 includes a rim 30 projecting along the axis x in the direction of the other side panel 2, 3. This rim 30 forms a bearing surface against which the distal end 38 of the bottom panel 6 comes to rest when it is in its deployed position. As represented in FIG. 4, this rim 30 can be covered by a foam element 31 in the portion intended to receive the distal end 38 of said bottom panel 6. This foam 31 in particular enables damping of noise and limitation of the play between the bottom panel 6 and its locking device.

The locking device includes a clip 32 mounted to pivot about an axis parallel to the axis y between an inactive position, represented in FIG. 4, in which it allows pivoting of said bottom panel 6 between its retracted position and its deployed position and an active position in which it presses the distal end 38 of the bottom panel 6 against the rim 30 of the side panel 2 and therefore prevents movement of said bottom panel 6 in the direction of its retracted position.

In the embodiment represented, the bottom panel 6 is equipped with a tab 35, represented in FIGS. 5 and 6 in particular, projecting toward the internal storage space and against which the clip 32 comes to abut when it is in its active position. The tab 35 and the clip 32 are sized so that they rub against one another when the clip 32 is in its active position, which locks the device. In fact, the user must exercise a force sufficient to overcome the friction forces in order to move the clip 32 from its active position to its inactive position.

As represented in FIG. 4, the bottom panel 6 and the top panel 7 are each equipped with a handgrip 34 enabling the user to maneuver the bottom panel 6 or the top panel 7 in order to pivot it between its deployed and retracted positions.

The use of the verbs "include", "comprise" and their conjugate forms does not exclude the presence of elements or steps other than those stated in a claim.

In the claims, any reference sign between parentheses should not be interpreted as a limitation of the claim.

The invention claimed is:

1. A folding piece of luggage (1) including:

parallel first and second rigid panels (2, 3);

third and fourth rigid panels (6, 7), each of which is mounted on and articulated to one of the first and second panels (2, 3) between a deployed position in which said third or fourth panel (6, 7) extends between said first and second panels (2, 3), perpendicularly to said first and second panels (2, 3), and a retracted position in which said third or fourth panel (6, 7) extends parallel to said first and second panels (2, 3); the third and fourth panels (6, 7) defining with the first and second panels (2, 3) a rigid frame when the third and fourth panels (6, 7) are in their deployed position;

fifth and sixth panels (4, 5) each of which connects the first and second panels (2, 3) and that define with the first, second, third and fourth panels (2, 3, 6, 7), when the third and fourth panels (6, 7) are in their deployed position, an internal storage space of parallelepipedal shape; the fifth and sixth panels (4, 5) being deformable in a direction x perpendicular to said first and second panels (2, 3) between an unfolded position and a folded position so that, when the third and fourth panels (6, 7) are in their retracted position, the first and second panels (2, 3) are able to move relative to one another in the direction x between an apart position of use in which the fifth and sixth panels (4, 5) are in their unfolded position and a together storage position in which the fifth and sixth panels (4, 5) are in their folded position, in which the sixth panel (4) is made from a rigid material and includes a central portion (17*a*) and two side portions (17*b*, 17*c*) that are disposed on respective opposite sides of the central portion (17*a*) in the direction x, one of the side portions (17*b*, 17*c*) being mounted on and articulated to the first panel (2) about a geometrical axis perpendicular to the direction x and the other of the side portions being mounted on and articulated to the second panel (3) about a geometrical axis perpendicular to the direction x, each of said side portions (17*b*, 17*c*) being mobile in rotation relative to the central portion (17*a*) about a geometrical axis perpendicular to the direction x, the folding piece of luggage (1) further including a holding device (21) that is fixed to the central portion (17*a*) of the sixth panel (4), the folding piece of luggage including at least two castor mechanisms that are respectively fixed to the first and second panels (2, 3) on respective opposite sides of the third panel (6).

2. The folding piece of luggage (1) as claimed in claim 1, in which the fifth panel (5) is made from a flexible material and includes:

a frame (40) defining an opening enabling access to the internal storage space;

a mobile flap (29) that is secured to the frame and that is able to close the opening of the frame in a closed position; and a first fixing device (10) configured to hold the mobile flap (29) fixed to the frame (40) in its closed position.

3. The folding piece of luggage (1) as claimed in claim 2, in which the mobile flap (29) is adapted to be positioned in a clamping position in which said mobile flap (29) is wrapped around the first and second panels (2, 3) when said first and second panels (2, 3) are in their together position so as to retain them in said together position, the folding piece of luggage (1) including a second fixing device configured to hold the mobile flap (29) in its clamping position.

4. The folding piece of luggage (1) as claimed in claim 1, in which the holding device includes a sheath that is fixed to the central portion of the sixth panel, a telescopic handle that is housed in said sheath and a handgrip that is fixed to one end of said telescopic handle.

5. The folding piece of luggage (1) as claimed in claim 1, in which each of said side portions (17*a*, 17*b*) is mounted on and articulated to one of the first and second panels (2, 3) by means of one or more hinges (20).

6. The folding piece of luggage (1) as claimed in claim 1, in which each of the side portions (17*b*, 17*c*) is connected to the central portion (17*a*) by a fold line (18, 19) providing a degree of freedom in rotation of said side portions (17*b*, 17*c*) relative to the central portion (17*a*).

7. The folding piece of luggage (1) as claimed in claim 1, including, for each of the third and fourth panels (6, 7), a locking device adapted when in an active state to retain said third or fourth panel (6, 7) in its deployed position.

8. The folding piece of luggage (1) as claimed in claim 1, in which each locking device includes a clip (32) that is mounted on and pivoted on one of the first and second panels (2, 3) between an active position in which said clip (32) presses a distal end of one of the third and fourth panels (6, 7) against a rim (30) of one of the first and second panels (2, 3) so as to prevent movement of said third or fourth panel (6, 7) from its deployed direction to its retracted position and an inactive position in which said clip (32) allows movement of said third or fourth panel (6, 7) between its retracted position and its deployed position.

9. The folding piece of luggage (1) as claimed in claim 8, in which each clip (32) is, in its active position, in contact against a tab (35) arranged at the distal end of said third or fourth panel (6, 7), said clip (32) and said tab (35) being adapted to exert a resistive friction torque opposing the movement of the clip (32) from its active position to its inactive position.

10. The folding piece of luggage (1) as claimed in claim 8, in which a foam element (31) is disposed between each of the third and fourth panels (6, 7) and the respective rim (30) when said third and fourth panels (6, 7) are in their deployed position.

11. The folding piece of luggage (1) as claimed in claim 1, in which the folding piece of luggage is a suitcase (1) and in which the first, second, third, fourth, fifth and sixth panels (2, 3, 4, 5, 6, 7) each has a rectangular general shape defining a rectangular parallelepiped in the deployed position, the first and second panels (2, 3) being side panels, the third and fourth panels (6, 7) respectively forming the lower panel and an top panel and form the smallest two faces of the rectangular parallelepiped, the fifth and sixth panels (4, 5) being respectively back and front panels and forming the largest two faces of the rectangular parallelepiped.

* * * * *